United States Patent [19]

Ackerman

[11] Patent Number: 4,497,401

[45] Date of Patent: Feb. 5, 1985

[54] DECORATIVE DISPENSING CONTAINER

[76] Inventor: Jacqueline B. Ackerman, 2170 Century Park East, Los Angeles, Calif. 90067

[21] Appl. No.: 476,827

[22] Filed: Mar. 18, 1983

Related U.S. Application Data

[63] Continuation-in-part of Ser. No. 360,010, Mar. 19, 1982, abandoned, which is a continuation-in-part of Ser. No. 333,722, Dec. 23, 1981, abandoned.

[51] Int. Cl.[3] ..... B65D 5/38

[52] U.S. Cl. ..... 206/131; 206/457; 206/259; 206/121; 229/9; 229/11

[58] Field of Search ..... 206/121, 131, 457, 259; 220/8; 229/19, 20, 11, 9

[56] References Cited

U.S. PATENT DOCUMENTS

| | | | |
|---|---|---|---|
| 422,405 | 3/1890 | Harbeck | 206/131 |
| 446,336 | 2/1891 | Forshaw | 206/131 |
| 459,870 | 9/1891 | Low | 206/131 |
| 1,637,358 | 8/1927 | Taylor | D27/31 |
| 2,108,444 | 2/1938 | Reilly | 428/913.3 |
| 2,279,614 | 4/1942 | Bryant | 206/259 |
| 3,650,383 | 3/1972 | Nigro | 229/19 |
| 3,866,751 | 2/1975 | Holert | 206/387 |

FOREIGN PATENT DOCUMENTS

| | | | |
|---|---|---|---|
| 2298446 | 8/1976 | France | 206/96 |
| 2460643 | 1/1981 | France | 206/818 |

OTHER PUBLICATIONS

Photographs of holder–see S.N. 333722

*Primary Examiner*—William T. Dixson, Jr.
*Assistant Examiner*—Brenda J. Ehrhardt
*Attorney, Agent, or Firm*—Lyon & Lyon

[57] ABSTRACT

A box-shaped decorative dispensing container comprises a sleeve, a drawer within the sleeve, and a decorative external case on the outside of the sleeve. The drawer can easily slide out of the case, while the sleeve is restricted from sliding out of the case.

13 Claims, 5 Drawing Figures

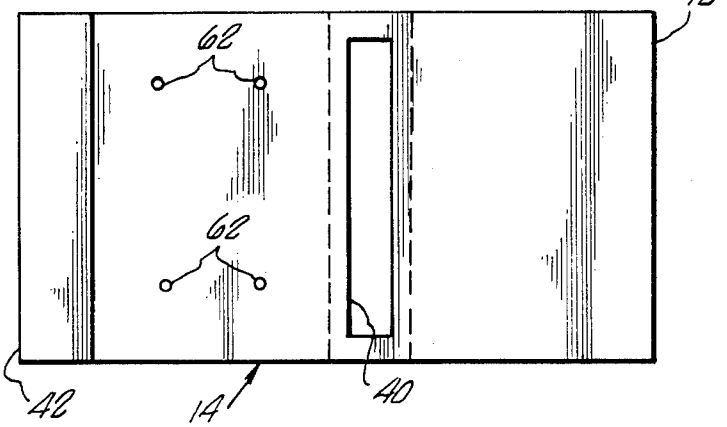
FIG. 1.
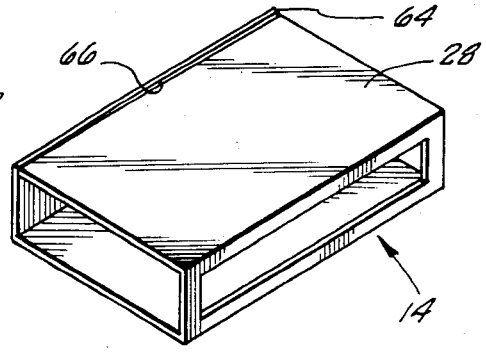
FIG. 4.
FIG. 2.
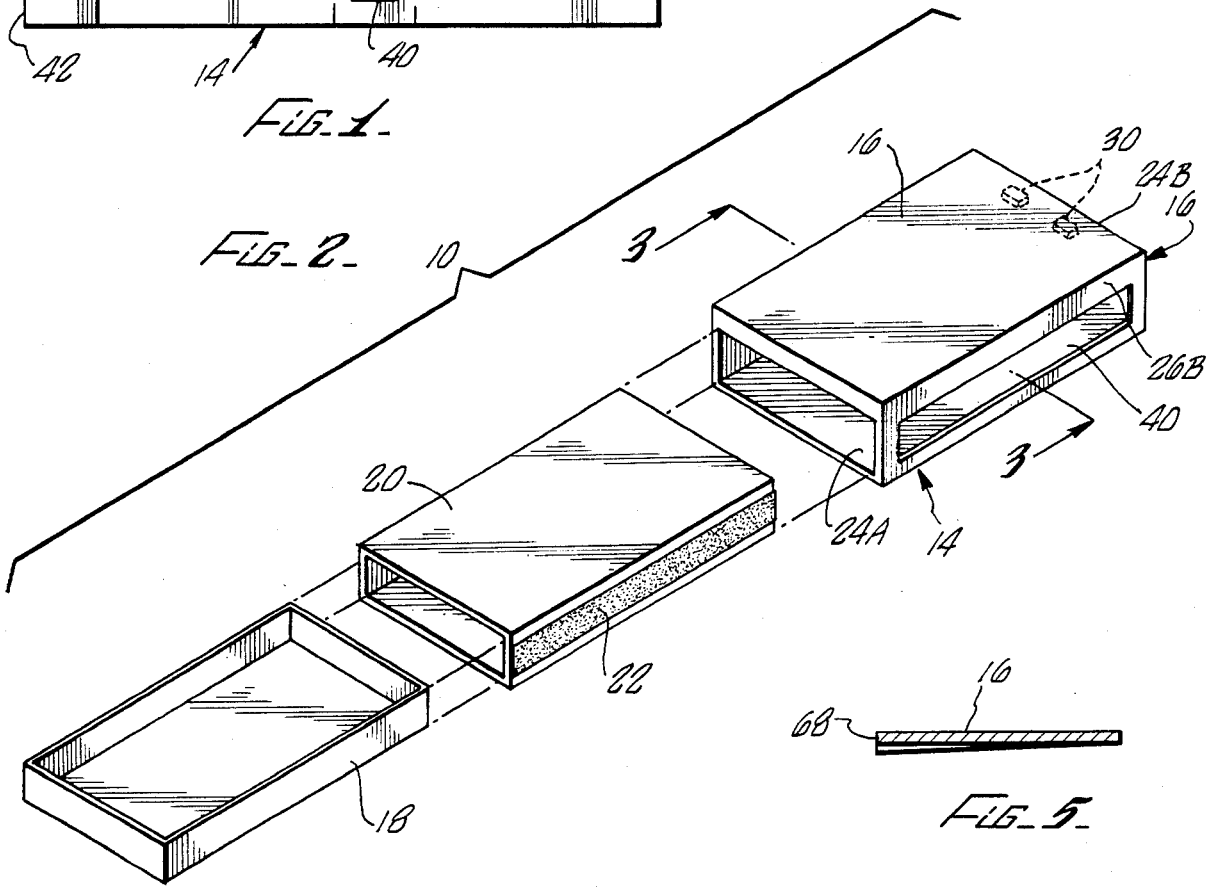
FIG. 5.
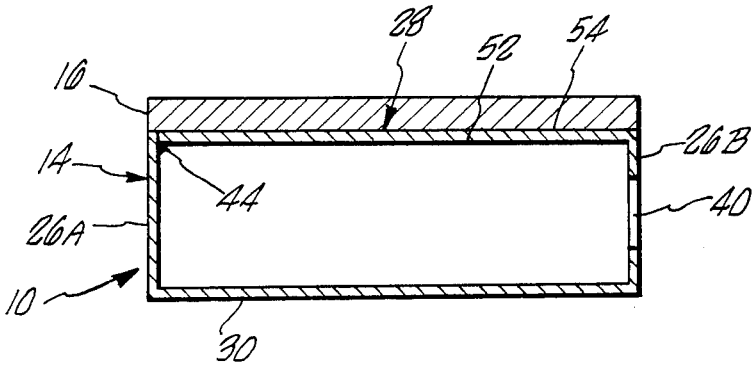
FIG. 3.

DECORATIVE DISPENSING CONTAINER

CROSS-REFERENCES

The application is related to my design application Ser. No. 333,724 filed on Dec. 23, 1981, entitled "Match Box Case." This application is a continuation-in-part of application Ser. No. 360,010 filed on Mar. 19, 1982, now abandoned, which is a continuation-in-part of application Ser. No. 333,722 filed on Dec. 23, 1981, also abandoned, both of which are incorporated herein by this reference.

BACKGROUND

The present invention relates to decorative dispensing containers for small objects.

Small utilitarian objects such as matches, paper clips, medicines, and the like generally come in containers which are unattractive. Decorative containers are available for such objects. However, such decorative containers usually have a hinged top, sliding top, or lift off cover. The prior art hinged top, sliding top, and lift off cover designs are generally unsatisfactory. The hinged and sliding tops are expensive to manufacture, while a lift off top provides very little security.

Thus, there is a need for a decorative dispensing container that is more secure and less expensive than prior art containers.

SUMMARY

The present invention provides a decorative dispensing container which meets these needs. The container is box-shaped, and comprises a sleeve, a drawer, and a decorative external case. The sleeve is substantially rectangular in cross section having opposing open ends, opposing side walls, a top wall, and a bottom wall.

The drawer is within the sleeve and is sized to slide in and out of the sleeve through the open end thereof. The drawer has an open top.

A decorative external case substantially rectangular in cross-section is on the outside of the sleeve. The case has opposing first and second open ends, opposing side walls, a top wall, and a bottom wall. The case continually tapers smaller from the first open end to the second end so that the cross-sectional area of the case decreases. The second open end of the case is smaller in cross-section than the first open end. The case is thus sized so that the sleeve can slide in from the large end of the case, but only the drawer and not the sleeve can slide out of the smaller end.

This decorative dispensing container is simple in construction and is easily manufactured, but can securely hold and dispense objects.

DRAWINGS

These and other features, aspects, and advantages of the present invention will become better understood with reference to the following description, appended claims, and accompanying drawings where:

FIG. 1 is a layout of a metallic sheet that is folded to form the case of a decorative dispensing container according to the present invention;

FIG. 2 is a perspective view of a decorative case according to the present invention with a sleeve and drawer ready to be slided thereinto;

FIG. 3 is a cross-sectional view of the case of FIG. 2 taken on line 3—3 of FIG. 2;

FIG. 4 is a perspective view of another case according to the present invention; and FIG. 5 is a sectional view of a plaque for mounting on the case of FIG. 4.

DESCRIPTION

The present invention is directed to a decorative dispensing container that is useful for containing and dispensing a variety of objects. The container can be sized for containing and dispensing such objects as thumbtacks, paper clips, matches, beads, cufflinks, stamps, valuable coins, diamonds, gold dust, old engagement rings, and the like.

The present invention will be described below with specific reference to a decorative dispensing container that is usable for matches. However, it is to be realized that this is only exemplary of dispensing containers according to the present invention.

A dispensing container 10 for matches comprises an external case 14, an inside container section or drawer 18 that has an open top in which matches (not shown) are stored, and an intermediate sleeve 20 that has a match strike strip 22 along one of its sides.

The case 14 of the container 10 has opposing open ends 24A and 24B, opposing side walls 26A and 26B, a top wall 28, and a bottom wall 30. The case 14 is substantially rectangular in cross-section as shown in FIG. 3 and is sized so that the sleeve 20 can slide easily in and out of the case through one of the open ends 24A, but so that the drawer 18 can slide in and out of the case through both open ends 24A, 24B.

When the case is desired for use as a matchbox holder one of the side walls 26B of the case 14 has an elongated rectangular opening 40 therethrough that corresponds to the strike strip 22 so that when the sleeve is within the case 10, it is possible to strike a match on the strike strip 22.

Open end 24B, of the case 16 is of slightly smaller cross-section than the other open end 24A. The cross-sectional size of open end 24B is sufficiently small that the sleeve 20 cannot easily slide out of the case that end, while the drawer 18 can easily slide out of the case through either open end.

The case continuously tapers from the larger end 24A to the smaller end 24B so that the transverse cross-sectional area of the case continuously decreases from the larger open end to the smaller open end. It is this tapered configuration that results in the second open end 24B being smaller in cross-section than the first open end 24A.

This is a preferred technique for obtaining the difference in cross-section area between the ends because, as described below, the case can be formed simply by folding a section of sheet metal along the appropriate lines. This is simpler than using flanges or the like which require additional folding or welding steps, which increases the cost of forming the case.

In another embodiment of the present invention, means are provided for releasably retaining the sleeve 20 within the case 14. For example, the sleeve can be constituted of a material capable of being attracted by a magnet such as a ferrous material and the case can have on its inner surface one or more small magnets 30. The magnets 30 are sufficiently strong to hold the sleeve within the case, but are sufficiently weak so that a person can easily separate the sleeve from the case.

Alternatively, the sleeve and case can be provided with interlocking fibrous material, such as that sold under the trademark Velcro.

Velcro materials are provided as two cooperating strips, the first strip consisting of fabric having plastic pile, the individual threads of which are resilient and flexible and are provided with a hook configuration at the free ends, and a second strip of fabric having a felt-like material of plastic threads on one side formed into complete loops or hooks which become interlocked with hooks on the first scrip.

In another version of the present invention, the sleeve and case can comprise materials that have a sufficiently high coefficient of friction therebetween that the sleeve cannot slide out of the case under its own weight. For example, the sleeve and the case can be made of gall prone metals, or the sleeve and/or case can be provided with Emery board, sand paper, or Velcro material.

Any or both of these alternate designs can be used together, i.e., the decorative dispensing container of the present invention can have (1) mechanical means for holding the case and sleeve together, and/or (2) a high coefficient of friction between the case and the sleeve.

The sleeve, case, and drawer can be made of substantially any material that has sufficient rigidity, including fabrics, cardboard, plastics and metals.

The case preferably is made of metal. As shown in FIG. 1, the case can be formed by die cutting a form or section 41 from a sheet of metal and folding along the dashed lines shown in FIG. 1 to result in the configuration shown in FIG. 2. In the folding operation, end portions 42 are matched and welded together as shown by weld 44 in FIG. 3. Adhesive can be used instead of or in addition to the weld.

The case 14 can include a decorative plaque 16 that comprises a metal substrate 52 with a decorative design 54 on one surface thereof. Preferably the plaque is made of copper or gold, or plated with copper or gold, so that an enamel cloisonne design is obtained. The cloisonne process involves placing pigmented enamel material on the copper substrate between upraised ridges thereby forming the finished design.

For ease in attaching the plaque to the case, preferably the metal substrate 52 and the case 14 are of the same material. For that reason, preferably the case is formed of copper or gold. Alternatively, the case can be plated with the same metal used for forming the plaque.

Any decorative design can be placed on the plaque. For example, designs representative of universities, fraternal organizations, trade associations, and businesses can be used.

The plaque is attached to the top surface of the case by welding and/or with an adhesive. A preferred technique is to use an adhesive bonding agent such as "Three Bond" super glue made by Three Bond of America of Santa Monica, Calif. In the use of "Three Bond", the case and plaque are placed in a press and subjected to 3 psig pressure at room temperature. The top wall 28 of the case can have a plurality of small holes 62 therethrough to assist in bonding the plaque to the case.

Although in the figures the plaque and the case are shown as separate units, when the final product is prepared, the line of demarcation between the plaque and the case cannot be seen.

It is possible to place the cloisonne design directly on the top surface of the case rather than on a separate plaque. However, it is preferred to use a separate plaque whose outer boundaries are coincident with the outer boundaries of the top wall of the case. This is so that the design can totally cover the entire top surface of the case. It has been found that if a design that does not completely cover the top surface of the case is placed directly onto the top surface of the case, unsightly chipping along the edges occurs. By using the separate plaque, it is possible to have a design on the entire top surface of the case without any unsightly chipping along the edges.

If desired, the entire sleeve can be lacquered to provide a glossy protective finish.

In use, after the sleeve and drawer are placed in the case the drawer 18 is slid out to obtain access to matches. After a match is removed from the drawer 18, the drawer 18 is slid back inside the sleeve 20 for safety, and a match is struck along the match strike strip 22.

In the version of the invention shown in FIG. 4, the top 28 of the case 14 is depressed slightly, about 1/16", at a corner 64 at the second end 24B of the case. When the end portion 42 are welded together this has two desirable results.

First, this pushes down the second end 24B of the case so that the sleeve 20 cannot easily slide out of the case. This is a simple and effective technique to obtain a tapered case.

Second, this leaves a small ledge 66 along the top of the side wall 26A. The plaque 16 can be seated against this ledge 66 and held in place while it is being secured to the case.

As shown in FIG. 5, the plaque 16 can be tapered to accommodate the ledge so that final product appears continuously smooth without the ledge being visible. The wider end 68 of the plaque is placed against the ledge.

Although the present invention has been described in considerable detail with reference to certain preferred versions thereof, other versions are possible. Therefore the spirit and scope of the appended claims should not necessarily be limited to the description of the preferred versions.

What is claimed is:

1. A box-shaped decorative dispensing container comprising:

(a) a sleeve substantially rectangular in cross-section having opposing open ends, opposing side walls, a top wall, and a bottom wall;

(b) a drawer within the sleeve, the drawer being sized to slide in and out of the sleeve through the open ends thereof; and (c) a decorative external case substantially rectangular in cross-section having opposing first and second open ends, opposing side walls, a top wall, and a bottom wall, the case continuously tapering smaller from the first end to the second end forming a cross-sectional area of the case continuously decreasing from the first open end to the second open end, and the second open end of the case being smaller in cross-section than the first open end, the sleeve with the drawer therein sliding in and out of the larger first open end of the case and only the drawer and not the sleeve sliding out of the smaller second open end of the case.

2. The container of claim 1 including means for releasably holding the sleeve in the case.

3. The container of claim 2 in which the sleeve and case comprise materials that have a sufficiently high coefficient of friction therebetween that the sleeve cannot slide out of the case by its own weight.

4. The container of claim 1 in which the sleeve and case comprise materials that have a sufficiently high coefficient of friction therebetween that the sleeve cannot slide out of the case by its own weight.

5. The container of claim 1 in which the sleeve and drawer comprise a matchbox with a strike strip thereon, a wall of the case having an elongated opening therein corresponding to the strike strip.

6. The container of claim 1 including a decorative plaque comprising a metal substrate with a decorative design on one surface thereof with the opposing surface of the plaque being secured to the top wall of the case, the edges of the plaque and the edges of the top wall of the case being substantially coincident.

7. The case of claim 6 in which the case and the metallic plaque are constituted of copper and the decorative design is an enamel cloisonne design.

8. A method for forming a decorative case suitable for holding a matchbox, the case being substantially rectangular in cross-section and comprising opposing first and second open ends, opposing side walls, a top wall and a bottom wall, the case continuously tapering smaller from the first end to the second end so that the cross-sectional area of the case continuously decreases from the first open end to the second open end, whereby the second open end of the case is smaller in cross-section than the first open end, the method comprising the steps of:

(a) forming a rectangular section of sheet metal, the section having elongated sides and a narrower top and bottom;

(b) folding the section into the shape of the elongated metallic sleeve by matching the top and bottom whereby the sides form the open ends of the case; and (c) securing the top and bottom of the section together.

9. The method of claim 8 wherein a wall of the case has an elongated opening therein corresponding to a strike strip on a matchbox, the step of forming comprises forming the elongated opening in the section, and the step of folding comprises folding the section so that the elongated opening is in a wall of the case.

10. The method of claim 8 comprising the additional steps of:

(a) forming an enamel design by the cloisonne process on a surface of a metallic plaque; and (b) securing the metallic plaque to the top wall of the case.

11. The method of claim 8 wherein the top and bottom are secured together to leave a ledge at the intersection of the top wall and one of the side walls.

12. The method of claim 11 including the step of securing a decorative plaque to the top wall of the case, wherein the plaque is tapered with a widened and and a narrow end with the wide end against the ledge.

13. A box-shaped decorative dispensing container comprising:

(a) a sleeve substantially rectangular in cross-section having opposing open ends, opposing side walls, a top wall, and a bottom wall;

(b) a drawer within the sleeve, the drawer being sized to slide in and out of the sleeve through the open ends thereof;

(c) a decorative external case substantially rectangular in cross-section having opposing first and second open ends, opposing side walls, a top wall, and a bottom wall, the case continuously tapering smaller from the first end to the second end forming a cross-sectional area of the case continuously decreasing from the first open end to the second open end, and the second open end of the case being smaller than the first open end, the the sleeve with the drawer therein sliding in and out of the larger first open end of the case and only the drawer and not the sleeve sliding out of the smaller second open end of the case, the case having a ledge at the intersection of the top wall and one of the side walls; and (d) a decorative plaque comprising a metal substrate with a decorative design on one surface thereof with the opposing surface of the plaque being secured to the top wall of the case, the edges of the plaque and the edges of the top wall of the case being substantially coincident, the plaque being tapered with a wide end and a narrow end, the wide end being against the ledge.

* * * * *